US006846129B1

(12) United States Patent
Edson

(10) Patent No.: US 6,846,129 B1
(45) Date of Patent: Jan. 25, 2005

(54) BOATLIFT AND MOVABLE CANOPY ASSEMBLY

(76) Inventor: Harvey Wilder Edson, 7583 Barnsbury, West Bloomfield, MI (US) 48324-3609

( * ) Notice: Subject to any disclaimer, the term of this patent is extended or adjusted under 35 U.S.C. 154(b) by 0 days.

(21) Appl. No.: 10/650,524

(22) Filed: Aug. 28, 2003

(51) Int. Cl.[7] ..... B63C 3/06
(52) U.S. Cl. ..... 405/3
(58) Field of Search ..... 405/3–7

(56) References Cited

U.S. PATENT DOCUMENTS 2,708,346 A * 5/1955 Smith ..... 405/3
3,077,742 A * 2/1963 Brown ..... 405/3
4,019,212 A * 4/1977 Downer ..... 405/3
4,683,902 A 8/1987 Wilson
5,224,569 A 7/1993 Hewitt et al.
5,281,077 A * 1/1994 Phillips ..... 405/3
5,573,026 A 11/1996 Griffith
5,709,501 A * 1/1998 Elbers ..... 405/3
5,769,105 A 6/1998 Margol et al.
5,947,639 A * 9/1999 Bishop et al. ..... 405/3
6,152,065 A * 11/2000 Gronstrand ..... 405/3

* cited by examiner

*Primary Examiner*—Frederick L. Lagman
(74) *Attorney, Agent, or Firm*—Law Offices of John Chupa & Associates, P.C.

(57) ABSTRACT

A boatlift assembly having a boat cradle portion and a canopy portion. The canopy portion and boat cradle portion are movably coupled to cause the canopy portion to be automatically raised when the boat cradle is lowered and to be automatically lowered when the boat cradle is raised.

20 Claims, 5 Drawing Sheets

BOATLIFT AND MOVABLE CANOPY ASSEMBLY

FIELD OF THE INVENTION

The present invention generally relates to a boat hoist assembly and more particularly to a boat hoist assembly which has a movable canopy assembly.

BACKGROUND OF THE INVENTION

Boat owners, particularly owners of relatively small boats (e.g., less than twenty five feet in length) oftentimes find it desirable to remove their boats from the lake or other body of water when the boat is not in use (i.e., boats of substantially any desired size or length may also benefit from being removed from the lake or other body of water). In order to lift their boats from the water, various elevating hoist devices have been developed which have a boat cradle portion which lifts the boat vertically to raise the hull of the boat above the waterline. These hoists or lifts permit a boat owner to raise their boat (or other watercraft) from the body of water and store the boat in this elevated position.

In order to protect the boat from the elements (e.g., the effects of sun and precipitation), a canopy is oftentimes placed over the boatlift to provide a modicum of protection from the weather. This is particularly important for boats with fine wood and fiberglass hulls, as continued exposure to ultraviolet rays from the sun degrade the fine wood (e.g., mahogany and teak woods), finish, fiberglass, and/or substantially any material that the boat may be constructed from and/or contain (e.g., vinyl seats). The more the boat may be brought under the cover of the canopy the better it will be protected from the elements. While a canopy does provide protection against the elements, it only provides the maximum benefit if it is relatively close to the boat itself. A problem occurs, however, in that boaters must have easy access to their boats (i.e., to board and/or load their boats). Many boat owners are forced to compromise in their placement of the canopy to allow access to the boat while providing at least some protection.

Other protective devices lower and raise a canopy or cover onto the top of a boat through cables and lines that hang above the boatlift. These canopies, however, due to their use of hanging cables provide the canopy or cover with an undesirable range of motion which extends beyond the vertical plane (i.e., the canopy is free to move laterally). This creates the potential for the canopy to undesirably contact the boat (e.g., the canopy may be repeatedly blown into the boat by a strong wind) and cause damage to the boat.

There is therefore a need for a boatlift and canopy assembly that overcomes the drawbacks of prior boatlifts. The below described invention successfully overcomes the "balancing act" of protection from the elements and ready access to the watercraft by providing an assembly which raises the canopy away from the boat as the boat is lowered into the water and which lowers the canopy closer to the boat as the boat is lifted from the water. The below described invention further provides a device having a positive control feature which prevents the canopy from moving in any direction other than the vertical direction.

SUMMARY OF THE INVENTION

It is a first non-limiting advantage of the present invention to provide a boatlift assembly having a movable canopy which overcomes the drawbacks associated with prior boat hoists having canopies.

It is a second non-limiting advantage of the present invention to provide a boatlift assembly which has a movable canopy that automatically moves in the direction opposite to the movement of the boat lifting cradle portion of the boatlift assembly.

It is a third non-limiting advantage of the present invention to provide a boatlift assembly which has a movable canopy whose movement is confined to moving in the vertical axis.

It is a fourth non-limiting advantage of the present invention to provide a boatlift assembly having four vertical support members; a cradle portion which is slidably coupled to each of the four support members, wherein the cradle portion is effective to abuttingly engage a hull of a boat; a canopy portion which is disposed over the cradle portion; a raising and lowering assembly having a cable and a pair of pulleys, wherein the cradle portion and the canopy portion are coupled to the cable effective to lower the canopy portion when the cradle portion is raised and to raise the canopy portion when the cradle portion is lowered.

It is a fifth non-limiting advantage of the present invention to provide a boatlift assembly which is effective to lift a boat in a substantially vertical direction, the boatlift assembly including a plurality of vertical support members, wherein the support members are spaced to define an outer periphery of the boatlift assembly; a boat cradle portion which is slidably coupled to each of the plurality of support members, wherein the boat cradle portion is confined to movement in a substantially vertical direction by the support members; a movable canopy portion having an opaque and generally waterproof cover which is disposed over the boat cradle portion, the canopy portion having a plurality of engagement members which confine the movable canopy portion to movement in a substantially vertical direction; and at least one cable and pulley system having a cable and a pair of pulleys, wherein the pair of pulleys are rotatably mounted to a unique one of the vertical support members and wherein the cable is looped around the pair of pulleys and is effective to interconnect the movable canopy portion to the boat cradle portion.

It is a sixth non-limiting advantage of the present invention to provide a boatlift assembly having four vertical support members, wherein the support members each have a square cross-sectional area, the support members being disposed relative to each other wherein two surfaces of each of the support members are each directed toward one of the other support members; a cradle portion which is effective to lift a boat in a substantially vertical direction, wherein the cradle portion includes four V-shaped wedges, each of which slidably engage a unique one of the four support members along two surfaces of the square cross-sectional area; a canopy portion which is disposed above the cradle portion and which includes four V-shaped wedges which each slidably engage a unique one of the four support members along the two surfaces of the support member which are opposite to the two surfaces which are slidably engaged with the cradle portion; and a raising and lowering assembly which couples the canopy portion to the cradle portion, effective to lower the canopy portion when the cradle portion is raised and to raise the canopy portion when the cradle portion is lowered.

These and other features and advantages of the present invention will become apparent from a reading of the detailed description of the preferred embodiment of the invention and by reference to the following drawings.

DETAILED DESCRIPTION OF THE PREFERRED EMBODIMENT OF THE INVENTION

The present invention may be understood more readily by reference to the following detailed description of preferred embodiments of the invention.

Before the present methods and assemblies are disclosed and described, it is to be understood that the terminology used herein is for the purpose of describing particular embodiments only and is not intended to be limiting. It must be noted that, as used in the specification and the appended claims, the singular forms "a", "an", and "the" include plural referents unless the context clearly dictates otherwise.

At the outset, it should be appreciated that, although the following descriptions of preferred and alternate embodiments are directed towards raising a boat from a body of water while concomitantly covering the raised boat, the applications of the present invention are not limited to lifting only a boat. Rather, as should be appreciated after reading the following detailed description, the present invention may be utilized to raise and cover substantially any desired object. For example and without limitation, the applications of the present invention may be utilized to lift and cover an automobile or other object (e.g., a classic sports car, a personal watercraft, a motorcycle, an airplane, and the like).

Figure 1:
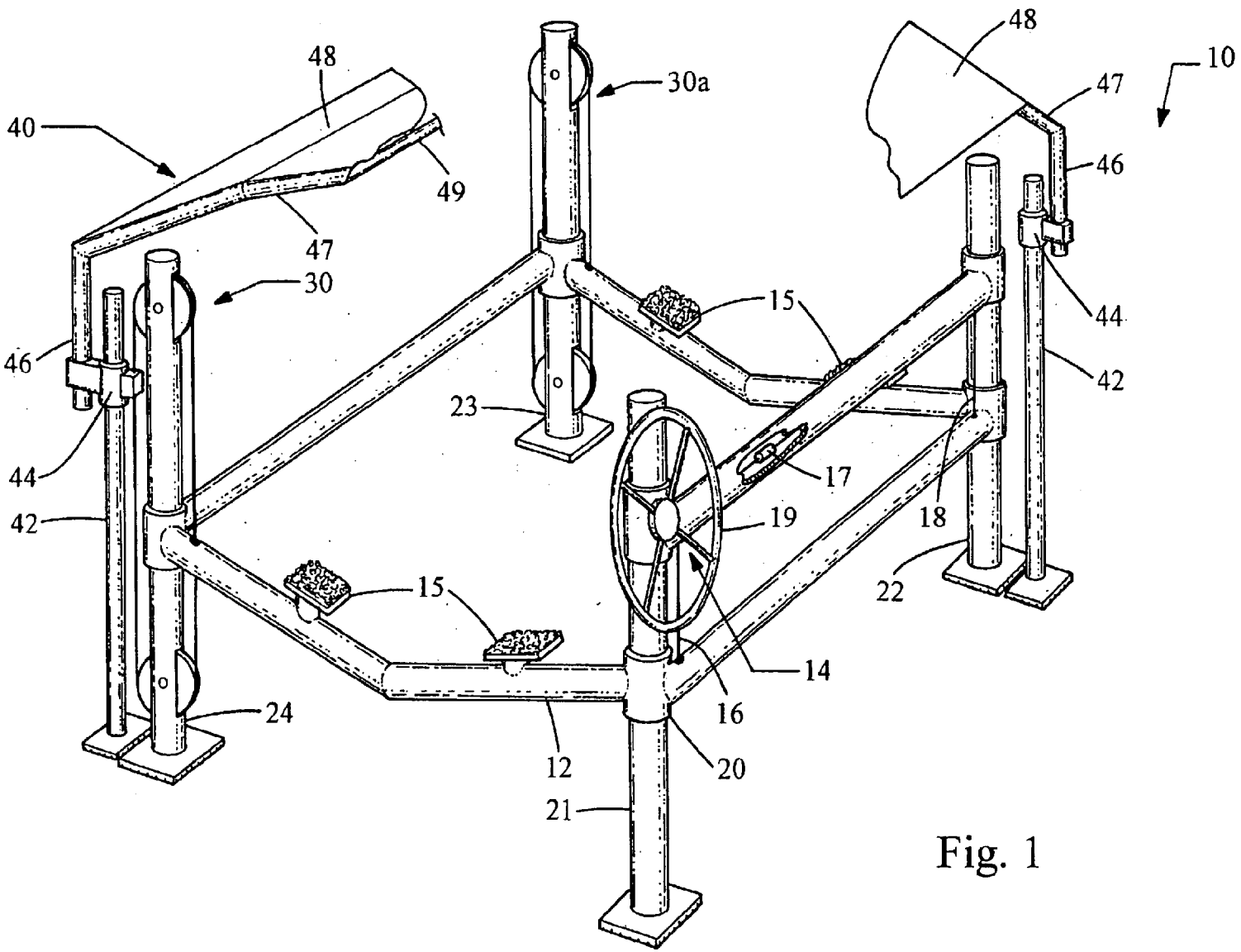
FIG. 1 is a perspective view of one non-limiting embodiment of the invention.
Figure 2:
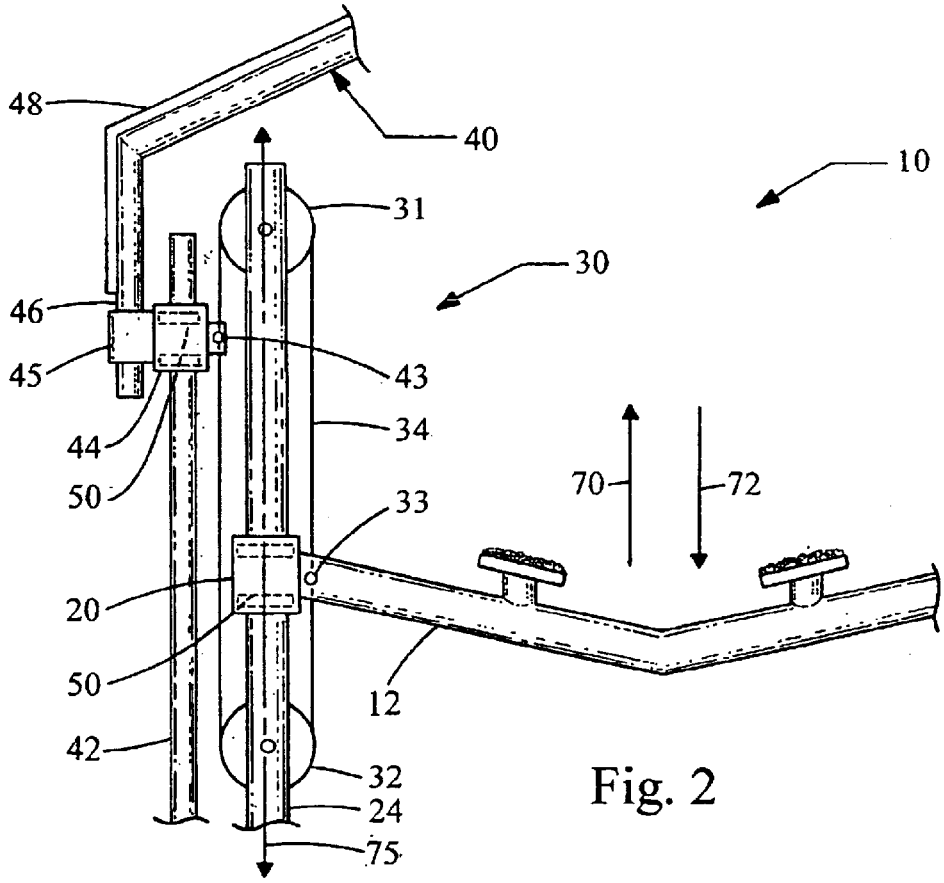
FIG. 2 is partial front view of the canopy raising and lowering means of the non-limiting embodiment shown in FIG. 1.

Referring now to FIGS. 1 and 2, an improved boat hoist or lift assembly 10 is shown. More particularly, boatlift 10 includes four vertical support poles or members 21–24 which are normally disposed within and project from a body of water (not shown). These members 21–24 cooperate to generally define the outer four corners of the boatlift 10. A cradle or platform portion 12 is slidably coupled to each of the members 21–24. That is, cradle 12 is formed from a generally rectangular frame having four bearing or sheave portions 20 at its four corners. Each sheave 20 has an interior aperture, which is sized to operatively and frictionally receive or engage a unique one of the support members 21–24. As shown, cradle 12 further includes a plurality of boat support members 15 which abuttingly engage the hull of a boat (not shown) when boatlift 10 is used to lift the boat from the water. Boatlift assembly 10 further includes a conventional winch assembly 14 which is operatively coupled to the cradle portion 12 through a cable and pulley system 16–18. For example and without limitation, winch assembly 14 includes at least two cables 16, 18 which are coupled through at least one pulley (not shown) to the slidable cradle 12. These cables 16, 18 are further coupled to each other through an interconnecting cable 17. Through cable and pulley system 16–18 a user may selectively rotate a handle or wheel 19 which is coupled to winch 14 to collect, gather, wind, or "take-up" a portion of the cable(s) 16–18. As the winch 14 is rotated, the length of the "unspoiled" or exposed portions of cable(s) 16–18 is shortened causing the sliding cradle portion 12 to move in an upward or vertical direction along the support members 21–24. It should be appreciated that the above described winch 14 and cable/pulley system 16–18 are just one of any number of mechanical systems which may be used to raise and lower cradle 12 along support members 21–24 and that nothing in this description should be construed to limit the raising and lowering means of cradle 12 to the one described.

Boatlift assembly 10 further includes a canopy portion 40 which is formed from a plurality of vertical support frame members 46 as well as lateral and transverse frame members 47, 49 which cooperate to form a frame or "skeleton" for the canopy cover portion 48 to be disposed upon. It should be appreciated that the canopy frame 46, 47, 49 substantially extends over each of the support members 21–24, as well as the cradle 12 and the remaining portions of boatlift 10. In one non-limiting embodiment, cover 48 is a generally waterproof and opaque material such as canvas, vinyl, or plastic which is coupled to the canopy frame by conventional fastening means (e.g., hook and pile, snaps, nuts and bolts, knots).

In other non limiting embodiments of the present invention, the canopy portion 40 may be geometrically configured or sized to closely fit between each of the support members 21–24, thereby further providing a canopy portion (not shown) that may be lowered in a manner which obviates any ambient lighting (e.g., sunlight) or any precipitation contacting the boat. That is, without the support members 21–24 limiting the motion of the canopy portion (not shown), the canopy portion (not shown) may directly abut and overlay the boat.

In yet another non-limiting embodiment of the present invention, the canopy portion 40 may include four substantially identical "cut-outs" or apertures (not shown). Each aperture (not shown) is geometrically configured to frictionally receive a respective one of the support members 21–24. In this manner, the canopy portion 40 may be substantially larger than the cradle 12, thereby ensuring that the entire boat (e.g., when hoisted from a body of water) will be substantially protected from the ambient light and precipitation. It should be appreciated that, in this manner, the range of motion of the canopy portion is not limited by the support members 21–40 and, in this manner, the canopy portion may be lowered directly upon the boat.

Canopy portion 40 is supported by four substantially identical vertical support members 42. Each of these support members 42 are disposed in relatively close proximity to a unique one of the support members 21–24 and are each substantially parallel to members 21–24. In one non-limiting embodiment of the invention, each member 21–24 is fixedly coupled to one of the canopy support members 42. Each canopy support member 42 is slidably coupled to the canopy portion 40 through a bearing member or sheave 44 which is similar to sheave 20. That is, each sheave 44 is a generally cylindrical member having an aperture which is sized to receivably permit a canopy support member 42 to slide therethrough. Each sheave is coupled to canopy portion 40 through a projection or flange 45 which is coupled to a vertical frame member 46. In this manner, canopy portion 40 is coupled to four sheaves 44 which are slidably mounted to four vertical canopy support members 42.

Boatlift assembly 10 further includes at least one canopy raising and lowering assembly 30. As is best shown in FIG. 2, each assembly 30 includes a pair of pulleys 31, 32 which are mounted to one of the vertical support members (such as member 24). Pulleys 31, 32 are rotatably mounted to the same member 24 in close proximity to the top and bottom of the member 24, respectively. A loop of cable 34 is disposed around pulleys 31, 32 wherein pulleys 31, 32 are substantially aligned to permit cable 34 to freely traverse around the pulleys 31, 32. Cable 34 is fixedly coupled to both cradle 12 and to sheave 44. Importantly, cable 34 is coupled to cradle 12 on one side of longitudinal axis 75 of the support member (e.g., support member 24) at point 33 and is coupled to the respective sheave 44 on the opposite side of axis 75 at point 43. In the preferred embodiment of the invention, points 33, 43 are disposed as far apart along the circumference of cable 34 as possible (i.e., are spaced apart one half of the overall length of cable 34) in order to provide the maximum amount of travel between canopy 40 and cradle 12. Further, connection point 33 is disposed in relatively close proximity to the bottom pulley 32 while connection point 43 is disposed in relatively close proximity to the top pulley 31.

By coupling the canopy 40 and cradle 12 on opposite sides of the cable/pulley system 31, 32, 34, these portions 40, 12 will always travel in opposite directions when the assembly 10 is used to raise or lower a boat. That is, when cradle 12 is moved in the direction of arrow 70 (to raise the cradle 12 and any boat disposed thereon), the canopy 40 will automatically move in the direction of arrow 72; downward toward the cradle 12 and the boat. When cradle 12 is moved in the direction of arrow 72 (to lower the cradle 12 and boat into the body of water), the canopy 40 will automatically move in the direction of arrow 70; upward away from the boat and cradle 12. It should be appreciated that the above described "opposite direction" movements of the cradle 12 and canopy 40 provide the desired effects of creating a relatively large amount of access and "head room" when the boat is lowered into the water (i.e., when the cradle 12 is "down" and the canopy 40 is "up") and by lowering the canopy 40 into as close of proximity as possible to a stored boat when the boat is raised up out of the water (i.e., when the cradle is up and the canopy is down).

In one non-limiting embodiment of the invention, more than one of the support members 21–24 have a canopy raising and lowering assembly 30 (such as the assembly 30*a* shown in phantom in FIG. 1), which is also coupled to the cradle 12 and to that respective corner's sheave 44. In this manner, the load (i.e., the weight of the boat and canopy 40) may be more fully distributed and the possibility of the sheaves 20, 44 binding against their respective supports 21–24, 42 may be reduced. In other non-limiting embodiments, each of the sheaves 20, 44 may include roller bearings 50 to reduce the frictional resistance and resist binding as the cradle 12 and canopy 40 are raised and lowered.

With respect to the following non-limiting embodiments of the invention, it should be appreciated that components and systems which are substantially the same as those that are described in reference to assembly 10, will be described utilizing the same reference numbers (e.g., canopy cover 48 is substantially the same in all embodiments and therefore has not been renumbered).

Figure 3:
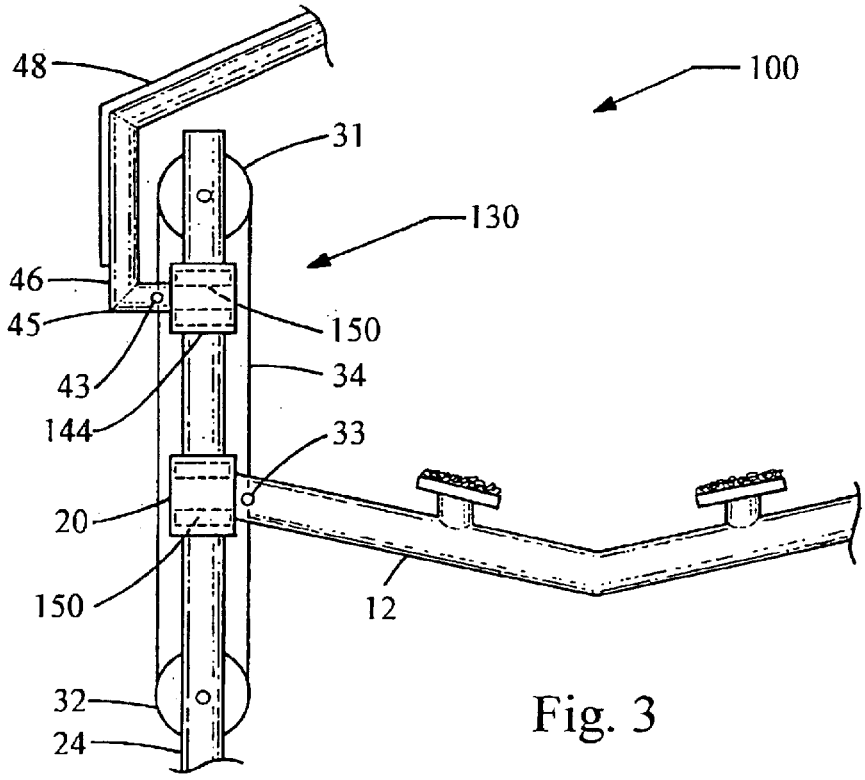
FIG. 3 is a partial front view of a canopy raising and lowering means of another non-limiting embodiment of the invention.

Referring now to FIG. 3, an alternate non-limiting embodiment of the invention is depicted wherein the boatlift assembly 100 is substantially the same as boatlift assembly 10 described above with the following changes.

As shown in FIG. 3, in this non-limiting embodiment the boatlift assembly 100 does not have separate canopy support members (i.e., members 42) that support the canopy portion 40. Instead, a second bearing member or sheave 144 is slidably disposed upon each support member 21–24. These second sheaves 144 are each substantially the same as sheave 20 and are disposed above the sheave 20 which is coupled to same support member 21–24. Both sheaves 20,144 are coupled to the cable 34 wherein the connection points 33, 43 are on opposite sides of the support member 24 and are disposed along the cable 34 as far apart as possible. It should be appreciated that the raising and lowering assembly 130, by nature of the oppositely positioned connection points 33, 43 still provided the above described opposite direction movements of canopy 40 and cradle 12, while reducing the number of components by eliminating the supports 42.

In other non-limiting embodiments, each of the sheaves 20, 144 may include roller bearings 150 to reduce the frictional resistance and resist binding as the cradle 12 and canopy 40 are raised and lowered.

Figure 4:
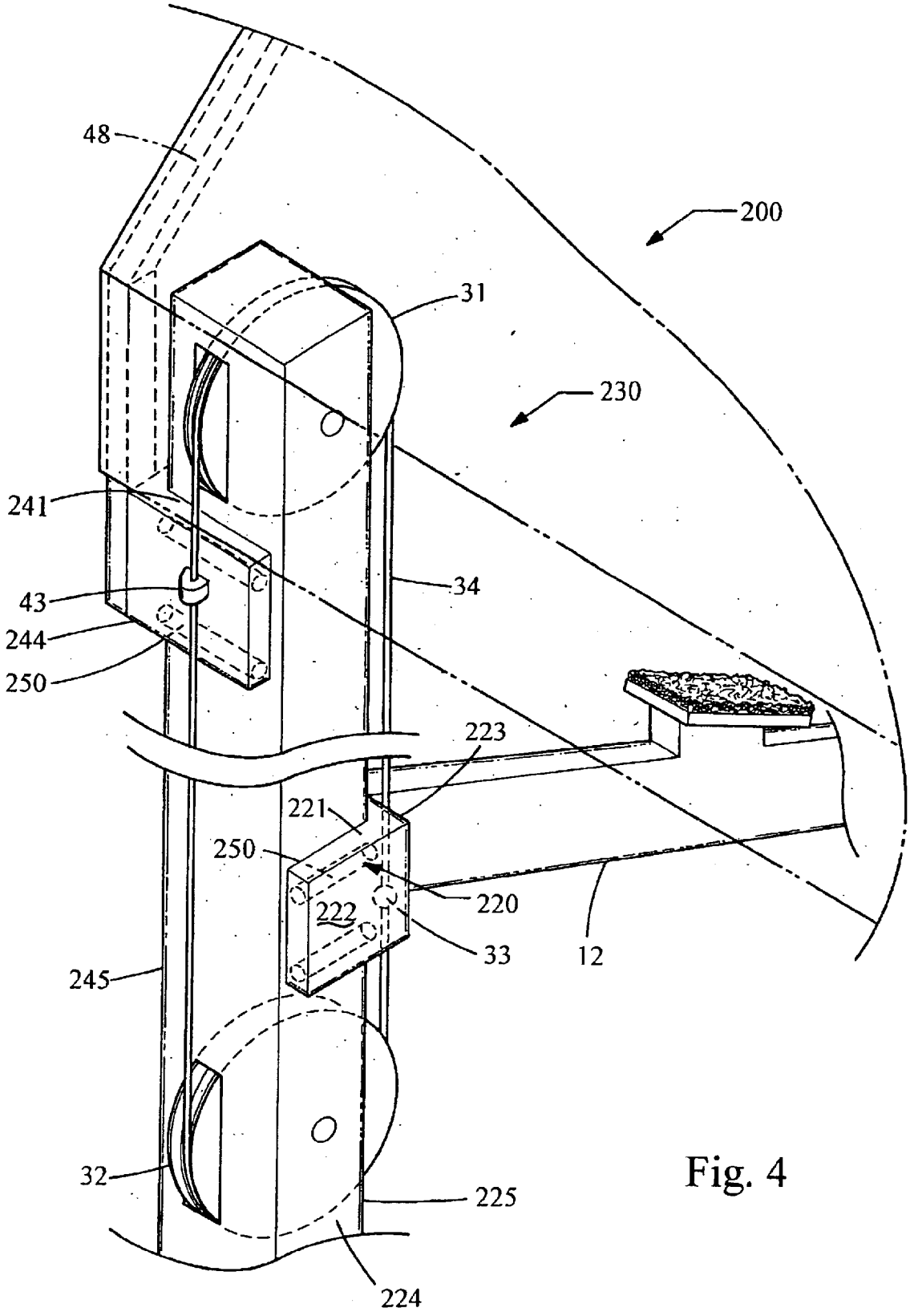
FIG. 4 is a partial perspective view of a canopy raising and lowering means of yet another non-limiting embodiment of the invention.

Referring now to FIG. 4, another non-limiting embodiment of the invention is depicted wherein the boatlift assembly 200 is substantially the same as boatlift assembly 10 described above with the following changes.

As shown in FIG. 4, this non-limiting embodiment of the invention provides four substantially square shaped support members 224 (i.e., there are four support members 224 which replace support members 21–24 from FIGS. 1–3). These square support member 224 are arranged so that one corner 225 is directed inward toward the center of assembly 200 and the opposite corner 245 is directed outward away from the center of assembly 200.

Assembly 200 further differs from assemblies 10, 100 in that assembly 200 does not have sheaves which are concentric to and surround the support member, but instead and because of the square cross-section of the support members 224, have a "V-shaped" wedge member 220 formed from two orthogonally projecting frictional surfaces 222, 223. Each of these wedge members 220 is coupled to cradle 12 and includes a sliding surface 221 which is formed from a relatively wear resistant material having smooth surfaces which contact the outer surfaces of member 224. Wedge member 220 is positioned relative to support member 224 so that corner 225 is located within the crux of the outwardly projecting surfaces 222, 223.

It should be appreciated that the four members 224 cooperate with the four wedge members 220 coupled to cradle 12 to prevent the cradle 12 from moving in any direction except along the longitudinal axis of the support member 224 (i.e., vertically).

Similarly, sheaves 44, 144 are each replaced in this non-limiting embodiment by another V-shaped wedge member 244. Wedge members 244 are substantially the same as wedge members 220 described above, but are disposed relative to each support member 224, wherein the outer corner 245 is located within the crux of the wedge member 244. That is, the wedge members 244 slide along the two outermost surfaces of support members 224, while wedge members 220 slide along the two innermost surfaces of support members 224. The canopy portion 40 is coupled to each of the four wedge members 244 in a manner which is substantially the same as that described above wherein the four wedge members 244 cooperate with the canopy frame 46, 47, 49 and the square support members 224 to substantially prevent the canopy portion 40 from moving in any direction except vertically.

In this non-limiting embodiment, both wedge members 220, 244 are coupled to the cable 34, wherein the connection points 33, 43 are on opposite sides of the support member 224 and are disposed along the cable 34 as far apart as possible. It should be appreciated that the raising and lowering assembly 230, by nature of the oppositely positioned connection points 33, 43 still provide the above described opposite direction movements of canopy 40 and cradle 12, while reducing the number of components by eliminating the supports 42 and concomitantly permitting a "full" range of travel as the V-shaped wedges 220, 244 will not collide as they near each other due to their frictional engagement with oppositely facing surfaces of the square cross-section support member 224.

In other non-limiting embodiments, each of the V-shaped wedges 220, 244 may include a plurality of roller bearings 250 which roll along the outer surface of support members 224 to reduce the frictional resistance and resist binding as the cradle 12 and canopy 40 are raised and lowered.

It should be appreciated that the above-mentioned additional frame members may be coupled to any of the support members 21–24, 46, 47, 49, 224 to increase structural stability and strength. It should further be appreciated that the weight of the interconnected cradle portion 12 and canopy portion 40 (by virtue of the raising lowering assemblies 30, 130, 230), provides a counterbalancing effect that reduces the amount of force which must be exerted to raise or lower these portions 40, 12 (with or without a boat). That is, the weight of the canopy portion 40 will assist a user of assemblies 10, 100, 200 to raise the cradle 12, while the weight of the cradle 12 (and boat) will assist in the raising of the canopy 40 as the cradle 12 and boat are lowered.

Figure 5:
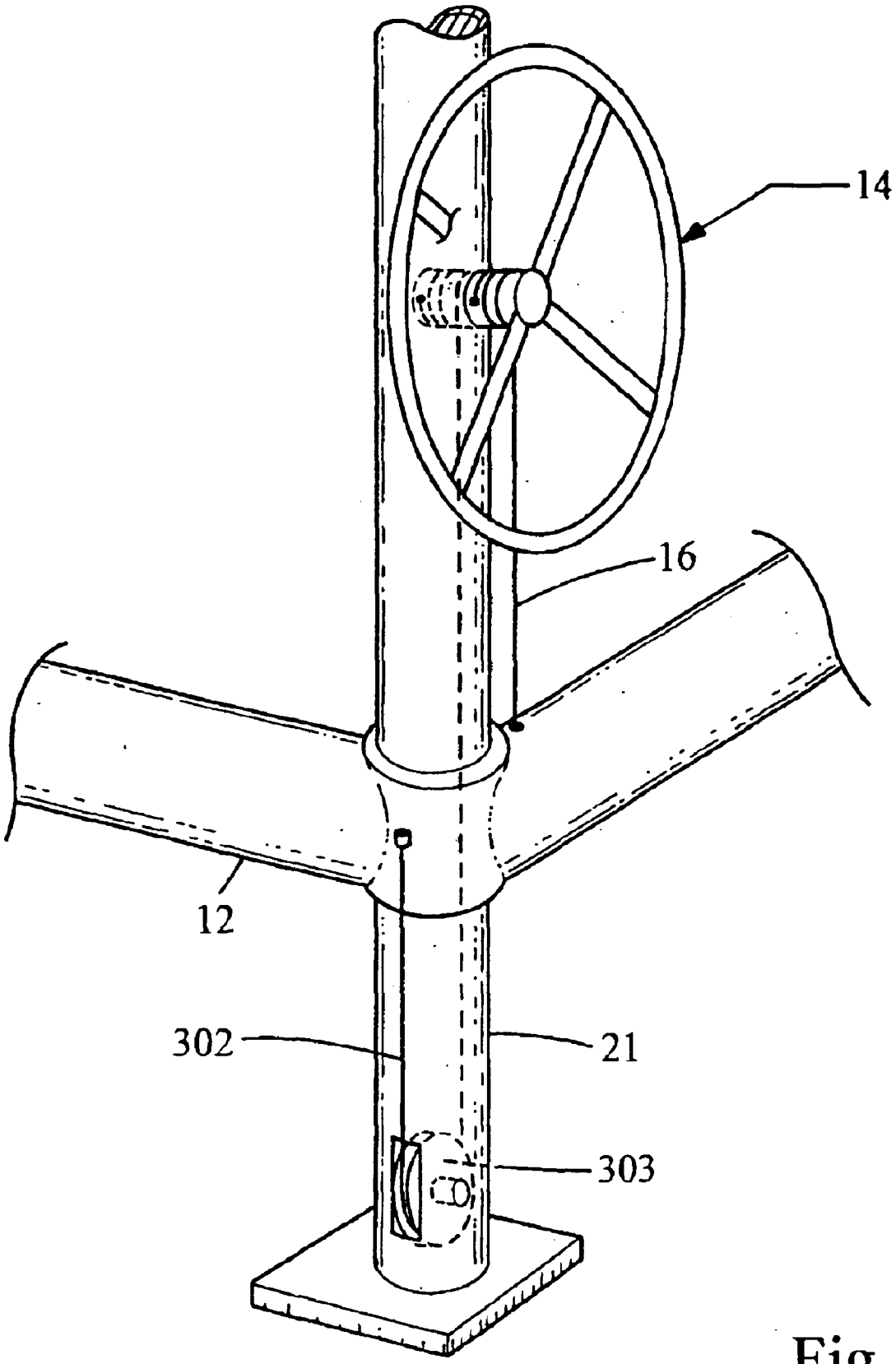
FIG. 5 is a partial perspective view of an alternate embodiment of the invention.

As shown in FIG. 5, to counter-act the weight of the canopy 40, in other non-limiting embodiment, and prevent it from raising the cradle 12 when the boat (or other object) is remote from the boat lift 10 a second cable 302 is coupled to the cradle 12 and the winch 14 via a pulley 303 which is disposed in relatively close proximity to the bottom end of one of the support members, such as member 21. This second cable and pulley system 302, 303 enables a user of the boat lift 10 to turn the winch 14 and "take in" a length of the cable 302 to positively lower the cradle 12. In other non-limiting embodiments, winch 14 may include a locking mechanism or ratcheting mechanism which allows the winch to be freely rotated in a first direction, but not in the opposite direction.

Additionally, by coupling the canopy portion 40 to the support members 21–24, 42, 224 using sheaves 44, 144 and interconnected wedge members 244, the above-described assemblies 10, 100, 200 substantially prevent the canopy 40 and its frame assembly 46, 48, 49 from moving in any direction other than vertically (in the direction of arrows 70, 72), thereby eliminating the possibility of the canopy 40 from swaying or swinging into the boat or watercraft disposed on the cradle 12 or into an individual located in close proximity to the boatlift 10, 100, 200 and reducing the likelihood of damage to the boat or injury to the individual.

In the preferred embodiment of the invention, the cradle 12 and the canopy 40 move respective to each other in a one to one ratio (e.g., if the cradle 12 is lowered one foot then the canopy 40 is raised one foot). In other non-limiting embodiments of the present invention, the abovementioned one to one ratio may be changed to substantially any desired ratio (e.g., the cradle 12 and the canopy 40 may have a two to one ratio or if the cradle 12 is lowered two feet then the canopy 40 may be raised only one foot). The above-mentioned ratio changes may be accomplished utilizing one or more of a plurality of methodologies which are well know and conventional. For example and without limitation, the boat lift 10 may incorporate one or more pulleys to accomplish a ratio change. That is, the pulley systems 30, 130, 230 which couple the cradle 12 to the canopy 40, may include additional pulleys/cables arranged to increase or decrease the respective raise/lower ratio through a conventional block and tackle configuration.

In yet another non-limiting embodiment of the present invention, the pulley systems 30, 130, 230 disclosed above may be substantially eliminated and replaced by a rigid mechanical arrangement, such as and without limitation, levers, fulcrums, and/or a series of interconnected cardan joints. For example and without limitation, the cradle 12 may abut a first end of a lever (not shown) which pivots on a fulcrum (not shown) while the opposite end of the lever (not shown) abuts the canopy 40. In this manner, when the cradle 12 is lowered, the first end of the lever (not shown) is forced downward, thereby causing the opposite end of the lever (not shown) to raise the canopy 40.

Figure 6:
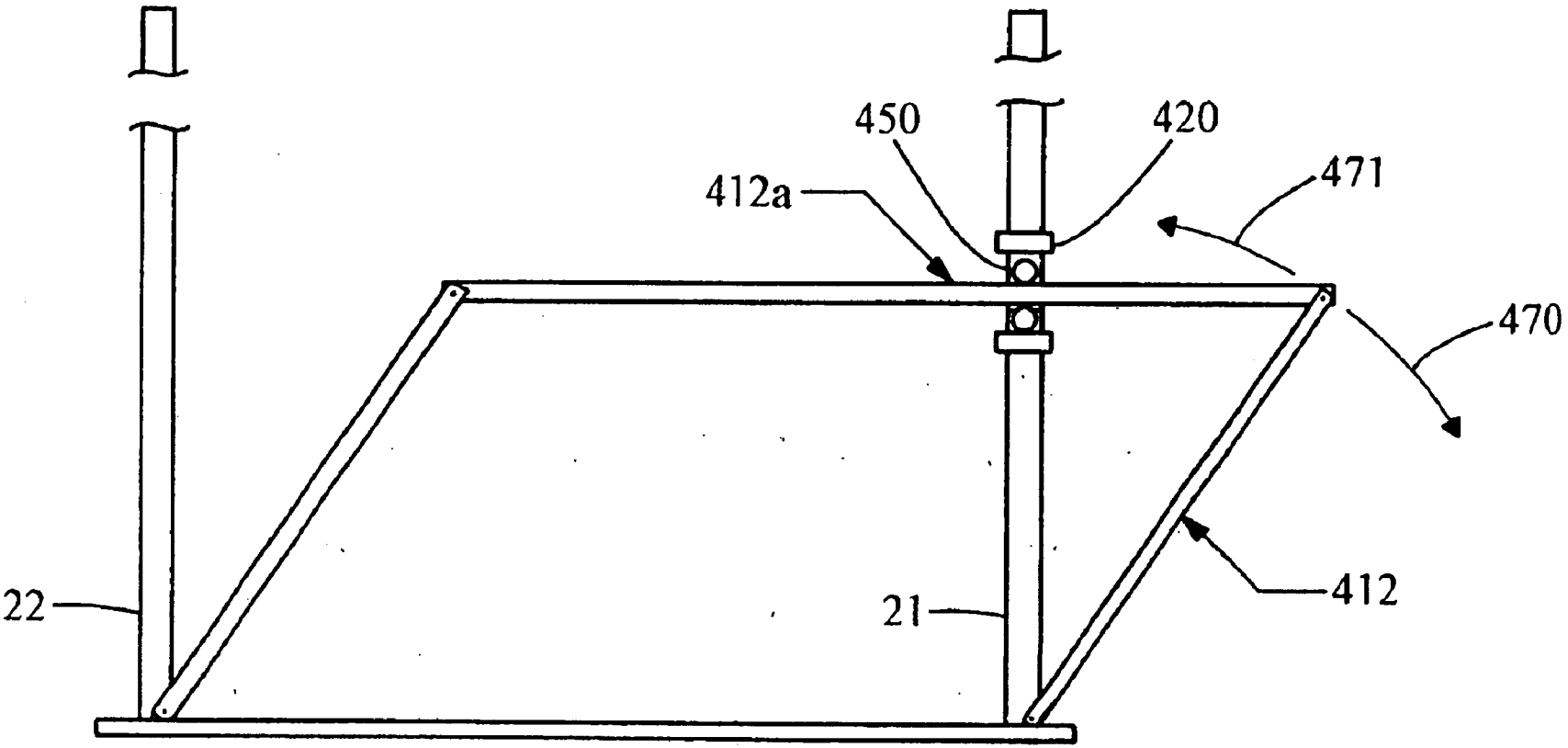
FIG. 6 is a side schematic view of yet another alternate embodiment of the invention.

It should be appreciated that nothing in this description should be construed to limit the raising of the boat or other object in a strictly vertical motion. (i.e., orthogonal to the water's surface), but that substantially any manner of lifting direction or means may be provided which is raised-up from beneath the object and abuts the bottom or hull and continues to lift until the boat or other object is raised above the waterline. For example and without limitation, and as shown in FIG. 6, the cradle assembly 412 may be pivotally coupled to the support members 21, 22 to rotate in an arcuate motion (e.g., in the directions of arrows 470, 471. As shown in this non-limiting example the sheave member 420 not only travels vertically along the support member 21, but also includes second sliding surfaces 450 (e.g., roller bearings) which surround and slidably engage a substantially horizontal support member 412A of the cradle 412. In this manner, when the pivoting cradle 412 is in a lowered position (underwater), the sheave member 420, which is coupled to the canopy (not shown) in substantially the same manner as described above, traverses not only down the support member 21, but along the horizontal cradle support member 412A.

What is claimed is:

1. A boatlift assembly comprising:

four vertical support members;

a cradle portion which is slidably coupled to each of said four support members, wherein said cradle portion is effective to abuttingly engage a portion of an object;

a canopy portion which is disposed over said cradle portion;

a raising and lowering assembly having a cable and a pair of pulleys, wherein said cradle portion and said canopy portion are coupled to said cable effective to automatically lower said canopy portion when said cradle portion is raised and to automatically raise said canopy portion when said cradle portion is lowered.

2. The boatlift assembly of claim 1 wherein said cradle portion includes four cradle sheaves and wherein a unique one of said cradle sheaves is disposed around a unique one of said support members.

3. The boatlift assembly of claim 2 further comprising four canopy sheaves which are coupled to said canopy portion and cooperate to confine said canopy portion to moving in a vertical direction.

4. The boatlift assembly of claim 3 further comprising four vertical canopy support members which are disposed parallel to said vertical support members, wherein a unique one of said canopy sheaves are slidably coupled to each of said vertical canopy support members.

5. The boatlift assembly of claim 3 wherein a unique one of said canopy sheaves is disposed around a unique one of said support members, and wherein said canopy sheaves are disposed above said cradle sheaves.

6. The boatlift assembly of claim 1 wherein said canopy portion includes a cover which is generally opaque and waterproof.

7. The boatlift assembly of claim 1 wherein said cradle portion and said canopy portion are coupled to said cable on opposite sides of said cable and as far apart as possible.

8. The boatlift assembly of claim 1 wherein said cradle portion and said canopy portion each include at least four roller bearings which reduce frictional resistance as said cradle portion and said canopy portion are raised and lowered.

9. The boatlift assembly of claim 2 wherein each of said four cradle sheaves includes at least one roller bearing assembly.

10. The boatlift assembly of claim 3 wherein each of said four cradle sheaves and said four canopy sheaves include at least one roller bearing assembly.

11. A boatlift assembly which is effective to lift a boat in a substantially vertical direction, said boatlift assembly comprising:

a plurality of vertical support members, wherein said support members are spaced to define an outer periphery of said boatlift assembly;

a boat cradle portion which is slidably coupled to each of said plurality of support members, wherein said boat cradle portion is confined to movement in a substantially vertical direction by said support members;

a movable canopy portion having an opaque and generally waterproof cover which is disposed over said boat cradle portion, said canopy portion having a plurality of engagement members which confine said movable canopy portion to movement in a substantially vertical direction; and at least one cable and pulley system having a cable and a pair of pulleys, wherein said pair of pulleys are rotatably mounted to a unique one of said vertical support members and wherein said cable is looped around said pair of pulleys and is effective to interconnect said movable canopy portion to said boat cradle portion, thereby causing said canopy portion to automatically move in response to movement of said cradle portion.

12. The boatlift assembly of claim 11 wherein said cradle portion and said movable canopy portion are coupled to said table on opposite sides of said looped cable.

13. The boatlift assembly of claim 12 wherein said cradle portion and said movable canopy portion are coupled to said cable a distance apart equal to one-half the length of said cable.

14. The boatlift assembly of claim 12 wherein said plurality of vertical support members are four vertical support members.

15. The boatlift assembly of claim 14 wherein said cradle portion and said movable canopy portion each include four sliding sheave portions.

16. The boatlift assembly of claim 15 wherein a unique one of said four cradle portion sheave portions is concentrically mounted around a unique one of said vertical support members.

17. The boatlift assembly of claim 12 further comprising a plurality vertical canopy support members which are each parallel to and proximate to a unique one of said plurality of vertical support members, wherein said movable canopy portion includes a plurality of sliding sheave portions which are each concentrically mounted around a unique one of said vertical canopy support members.

18. A boatlift assembly comprising:

four vertical support members, wherein said support members each has a square cross-sectional area, said support members being disposed relative to each other wherein two surfaces of each of said support members are each directed toward one of the other support members;

a cradle portion which is effective to lift a boat in a substantially vertical direction, wherein said cradle portion includes four V-shaped wedges which each slidably engage a unique one of said four support members along two surfaces of said square cross-sectional area;

a canopy portion which is disposed above said cradle portion and which includes four V-shaped wedges which each slidably engage a unique one of said four support members along the two surfaces of said support member which are opposite to said two surfaces which are slidably engaged with said cradle portion; and a raising and lowering assembly which couples said canopy portion to said cradle portion, effective to lower said canopy portion when said cradle portion is raised and to raise sa id canopy portion when said cradle portion is lowered.

19. The boatlift assembly of claim 18 wherein each of said V-shaped wedges include at least one roller bearing assembly to reduce frictional resistance as said cradle portion and said canopy portion are raised and lowered.

20. The boatlift assembly of claim 18 wherein each of said V-shaped wedges have plastic sliding surfaces which abuttingly engage said vertical support members.

* * * * *